US008305280B2

(12) United States Patent
Brown et al.

(10) Patent No.: US 8,305,280 B2
(45) Date of Patent: Nov. 6, 2012

(54) LOW LOSS BROADBAND PLANAR TRANSMISSION LINE TO WAVEGUIDE TRANSITION

(75) Inventors: Kenneth W. Brown, Yucaipa, CA (US); Andrew K. Brown, Rancho Cucamonga, CA (US); Darin M. Gritters, Yucaipa, CA (US); Michael J. Sotelo, Rancho Cucamonga, CA (US); Thanh C. Ta, Rancho Cucamonga, CA (US)

(73) Assignee: Raytheon Company, Waltham, MA (US)

( * ) Notice: Subject to any disclaimer, the term of this patent is extended or adjusted under 35 U.S.C. 154(b) by 442 days.

(21) Appl. No.: 12/612,591

(22) Filed: Nov. 4, 2009

(65) Prior Publication Data

US 2011/0102284 A1 May 5, 2011

(51) Int. Cl.
*H01Q 13/10* (2006.01)

(52) U.S. Cl. ..... 343/767; 343/771

(58) Field of Classification Search ..... 343/700, 343/767, 770, 771

See application file for complete search history.

(56) References Cited

U.S. PATENT DOCUMENTS

| | | | | |
|---|---|---|---|---|
| 3,969,691 | A | | 7/1976 | Saul |
| 4,260,964 | A | | 4/1981 | Saul |
| 4,500,887 | A | | 2/1985 | Nester |
| 4,550,296 | A | | 10/1985 | Ehrlinger |
| 4,651,115 | A | | 3/1987 | Wu |
| 4,672,384 | A | * | 6/1987 | Roy et al. ..... 343/725 |
| 4,782,346 | A | * | 11/1988 | Sharma ..... 343/795 |
| 5,202,648 | A | | 4/1993 | McCandless |
| 5,600,286 | A | | 2/1997 | Livingston |
| 6,002,305 | A | * | 12/1999 | Sanford et al. ..... 333/26 |
| 6,043,785 | A | * | 3/2000 | Marino ..... 343/767 |
| 6,100,853 | A | * | 8/2000 | Schaffner et al. ..... 343/771 |
| 6,144,266 | A | | 11/2000 | Heidemann |
| 6,509,809 | B1 | | 1/2003 | Lynch |
| 6,639,486 | B2 | | 10/2003 | Buck |
| 6,967,624 | B1 | | 11/2005 | Hsu |
| 7,088,300 | B2 | | 8/2006 | Fisher |
| 7,382,212 | B2 | | 6/2008 | Lo Hone Tong |
| 2003/0042993 | A1 | | 3/2003 | Sayanagi et al. |
| 2004/0212537 | A1 | | 10/2004 | Mohammadian |

FOREIGN PATENT DOCUMENTS

| | | |
|---|---|---|
| EP | 0905814 A2 | 3/1999 |
| JP | 8139504 | 5/1996 |
| JP | 2002208806 | 7/2002 |

OTHER PUBLICATIONS

European Patent Office, International Search Report and Written Opinion for International Application No. PCT/US2010/047576, mail date Dec. 8, 2010, pp. 1-13.

Radiom et al., An Effective Technique for Symmetric Planar Monopole Antenna Miniaturization, IEEE Transactions on Antennas and Propagation, IEEE Service Center, vol. 57, No. 10, Oct. 1, 2009, pp. 2989-2996.

(Continued)

*Primary Examiner* — Tho G Phan

(57) ABSTRACT

A transition for coupling a microwave signal between a transmission line formed on a planar dielectric substrate and a hollow waveguide may include a half-notch antenna formed on a portion of the dielectric substrate extending into an open end of the hollow waveguide.

20 Claims, 6 Drawing Sheets

OTHER PUBLICATIONS

Ting-Huei Lin and Ruey-Beei Wu, CPW to Waveguide Transition with Tapered Slotline Probe, IEEE Microwave and Wireless Componnets Letters, vol. 11, No. 7, Jul. 2001.

Yu Lou, An In-Line Waveguide-toMicrostrip-Transition Using Radial-Shaped Probe, IEEE Microwave and Wireless Components Letters, vol. 18, No. 5, May 2008.

Richard Q. Lee, Notch Antennas, NASA/TM-2004 213057, Jul. 2004, E-14503, NASA Center for Aerospace Information, Glenn Research Center, Cleveland, OH, http://gltrs.grc.nasa.gov.

R.N. Simons and S.R. Taub, New Coplanar Waveguide to Rectangular Waveguide End Launcher, Electronics Letters, Jun. 4, 1992, vol. 28, No. 12.

* cited by examiner

Section B-B

LOW LOSS BROADBAND PLANAR TRANSMISSION LINE TO WAVEGUIDE TRANSITION

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to microwave and millimeter wave circuits and particularly to transitions for coupling signals between microstrip and waveguide transmission lines.

2. Description of the Related Art

Microwave and millimeter wave circuits may use a combination of rectangular and/or circular waveguides and planar transmission lines such as stripline, microstrip and co-planar waveguides. Waveguides are commonly used, for example, in antenna feed networks. Microwave circuit modules typically use microstrip transmission lines to interconnect microwave integrated circuit and semiconductor devices mounted on planar substrates. Transition devices are used to couple signals between micro strip transmission lines and waveguides.

Throughout this description, elements appearing in figures are assigned three-digit reference designators specific to the element. An element that is not described in conjunction with a figure may be presumed to have the same characteristics and function as a previously-described element having the same reference designator.

DETAILED DESCRIPTION

In this patent, the term "waveguide" has the relatively narrow definition of an electrically conductive pipe having a hollow interior passage for guiding an electromagnetic wave. The cross-sectional shape, normal to the direction of propagation, of the interior passage may commonly be rectangular or circular, but may also be square, oval, or an arbitrary shape adapted for guiding an electromagnetic wave. The term "planar transmission line" means any transmission line structure formed on a planar substrate. Planar transmission lines include striplines, micro strip lines, coplanar lines, slot lines, and other structures capable of guiding an electromagnetic wave.

Figure 1:
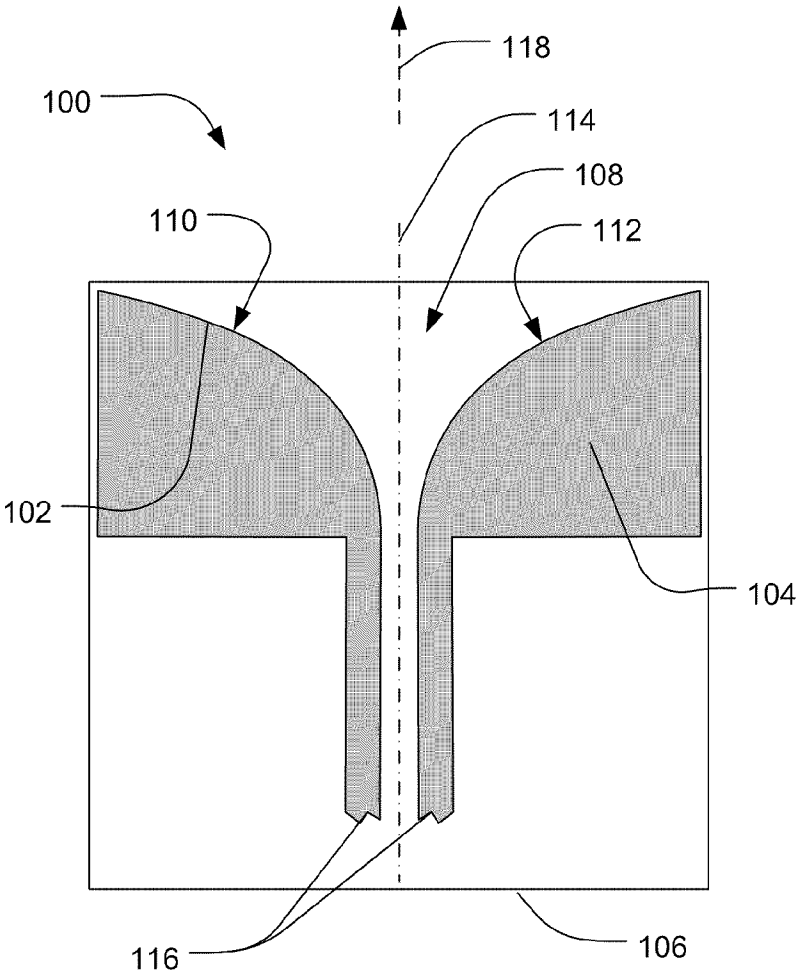
FIG. 1 is a schematic plan view of a notch antenna.

The relative position of various elements of a planar transmission line to waveguide transition, as shown in the drawings, may be described using geometric terms such as top, bottom, above, below, left and right. These terms are relative to the drawing view under discussion and do not imply any absolute orientation of the planar transmission line to waveguide transition Referring now to FIG. 1, a notch antenna 100 may include a first tapered tapered conductor 102 and a second tapered conductor 104 formed on a dielectric substrate 106. In this patent, the term "tapered" means a gradual change in width (a dimension of the conductor normal to a direction of propagation), from wider to narrower along the direction of propagation. In FIG. 1, the direction of propagation is indicated by the arrow 118. The tapered conductors 102, 104 may be separated by a gap 108 which widens, or flares, towards the free space side of the antenna (the top side as shown in FIG. 1) due to the taper of the conductors. The gap 108 may widen linearly or nonlinearly. A notch antenna may alternatively be termed a "flared notch antenna", or a "tapered slot antenna". A notch antenna where the edges 110, 112 of the first and second electrodes 104, 104 have a parabolic, elliptical, or other curved shape may commonly be termed a "Vivaldi antenna".

Variations of the notch antenna 100 may include tapered conductors on both sides of the dielectric substrate, including configurations where the first tapered conductor 102 is on one side of the substrate 106 and the second tapered conductor 104 is on an opposing side of the conductive substrate. The first and second tapered conductors 102, 104 may be symmetrical about a center line 118, as shown in FIG. 1, or asymmetrical.

The notch antenna 100 is an end fire traveling wave antenna that radiates in a symmetrical pattern centered about the propagation direction indicated by the arrow 118. Notch antennas are known to provide high bandwidth and moderate gain. An input 116 to one or both of the tapered conductors 102, 104 may be fed, through a suitable impedance match, from a stripline, a micro strip line, a coplanar waveguide, or other planar transmission line.

Figure 2:
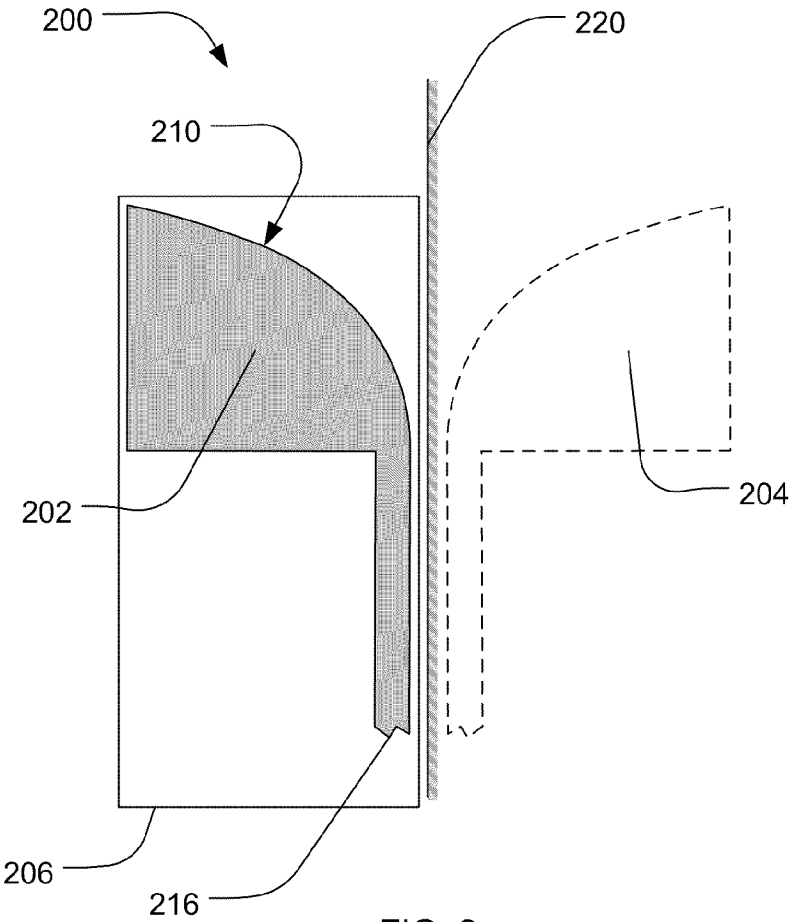
FIG. 2 is a schematic plan view of a half-notch antenna.

FIG. 2 is a schematic plan view of what will be referred to in this patent as a "half-notch" antenna. The half-notch antenna 200 may include a single tapered conductor 202 formed on a dielectric substrate 206 and a ground plane 220. The ground plane 220 effectively reflects the tapered conductor 202 to form a virtual conductor 204. The tapered conductor 202 and the virtual conductor 204 effective constitute a notch antenna as previously described.

An edge 210 of the tapered conductor 202 may be linear or curved, as shown in FIG. 2. The edge 210 may follow a circular, elliptical, parabolic, or other curved shape. The edge 210 may follow a series of linear segments or steps that approximate a curved shape. An input 216 to the tapered conductor 202 may be fed, through a suitable impedance match, from a strip line, a microstrip line, a coplanar waveguide, or other planar transmission line.

Figure 3:
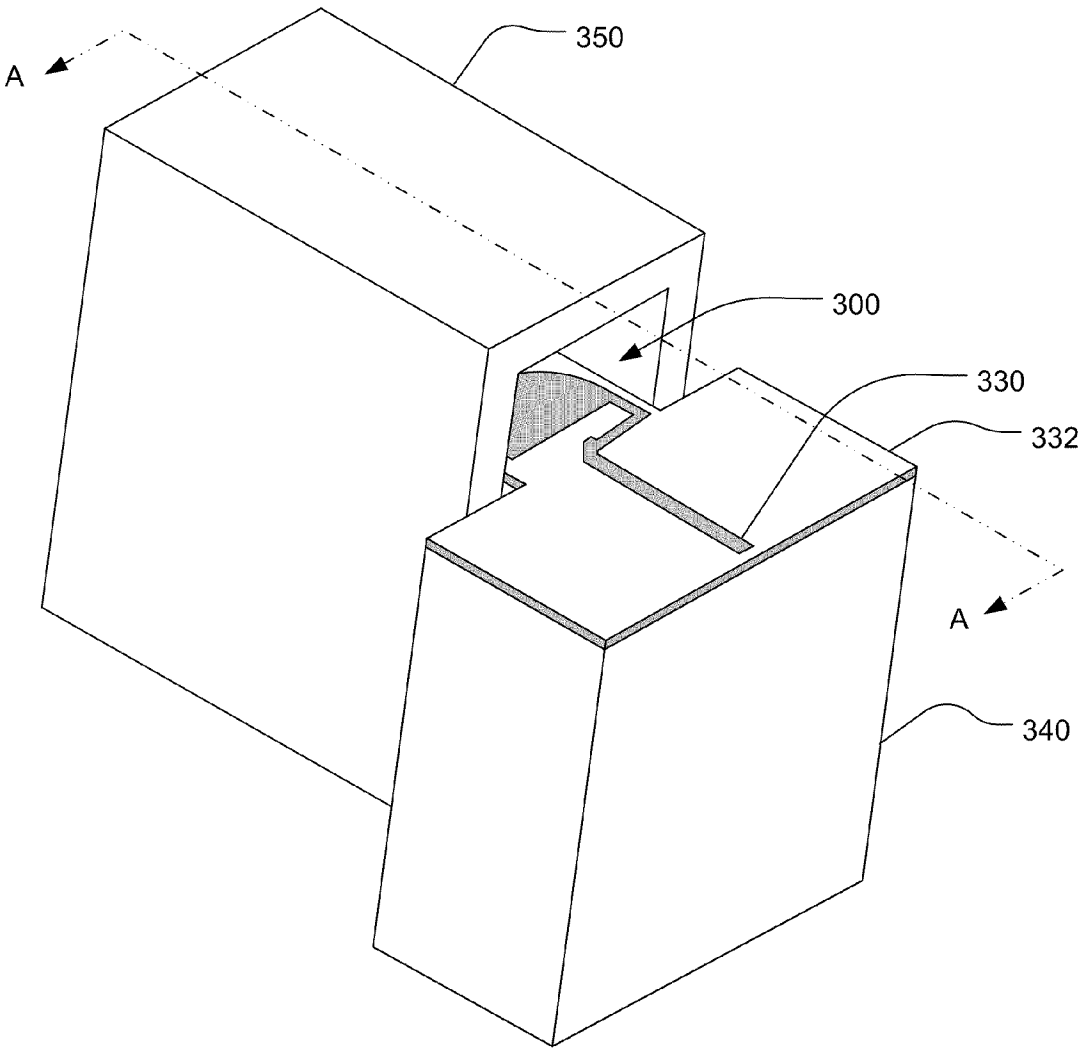
FIG. 3 is a perspective view of an exemplary low loss broadband microstrip to waveguide transition.

FIGS. 3-6 show an exemplary planar transmission line to waveguide transition. In FIG. 3, a half-notch antenna 300, which is only partially visible, may be used as a transition between a microstrip line 330 and a waveguide 350. The half-notch antenna 300 may be inserted into an open end of the waveguide 350. The walls of the waveguide 350 may act as a ground plane to reflect a virtual image (not shown) of the half notch antenna 300. The half notch antenna 300 and the virtual image may effectively constitute a notch antenna as previously described. In the example of FIG. 3, the waveguide 350 is shown with a rectangular cross section, but the waveguide 350 may be rectangular, square, circular, or may have some other geometric or arbitrary cross-sectional shape. The cross sections shape may vary along waveguide.

The microstrip line 330 may be formed on a dielectric substrate 332. The dielectric substrate 332 may be coupled to a ground plane slab 340. The dielectric substrate 332 may be, for example, bonded to the ground plane slab 340. The ground plane slab 340 may serve as a heat sink to spread or remove heat generated by electronic components (not shown) mounted on the dielectric substrate 332. The ground plane slab 340 may be formed of, for example, copper, aluminum, or another electrically and thermally conductive material. The ground plane slab 340 may be electrically connected to the waveguide 350.

Figure 4:
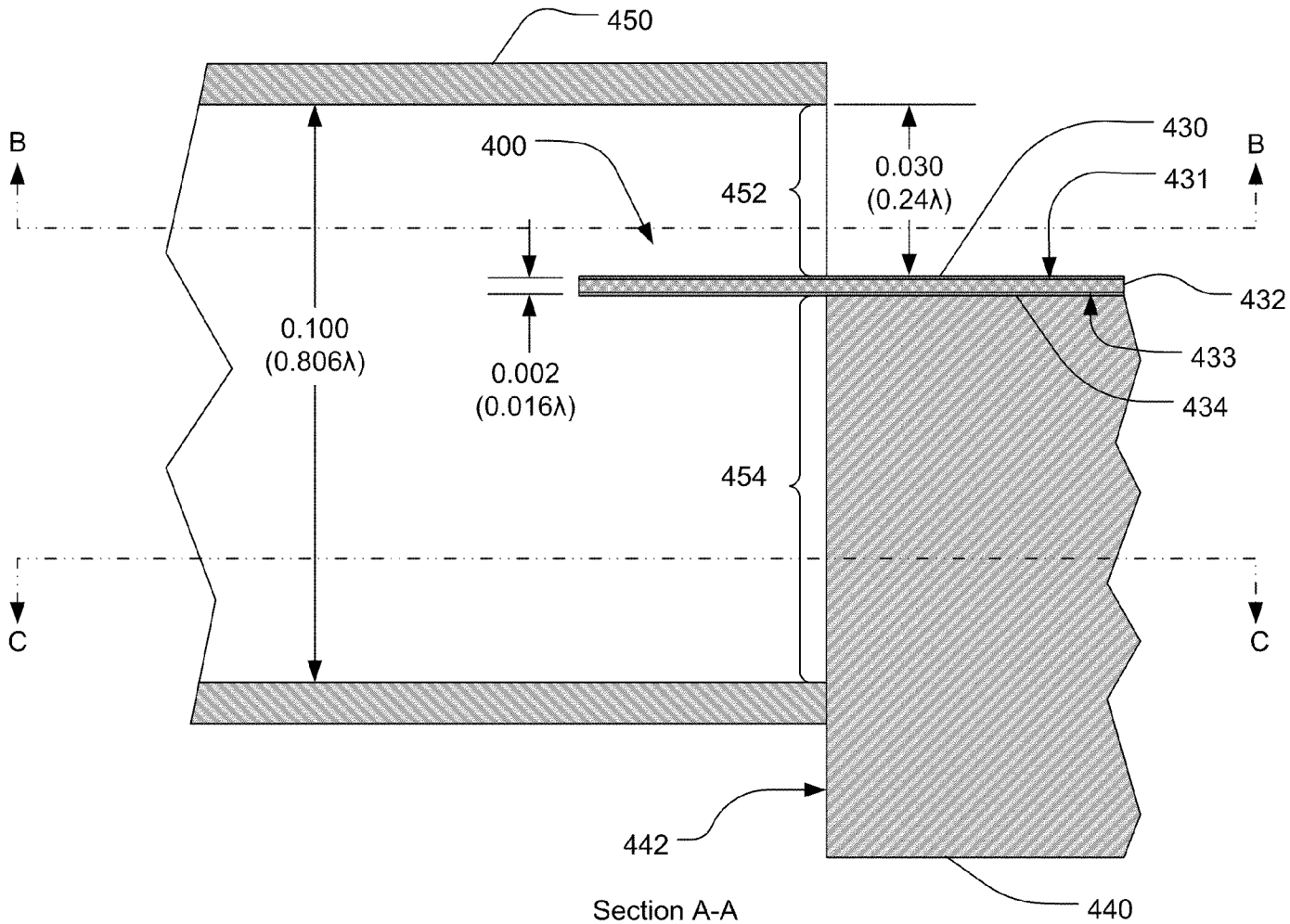
FIG. 4 is a cross-sectional view of the exemplary low loss broadband microstrip to waveguide transition.
Figure 5:
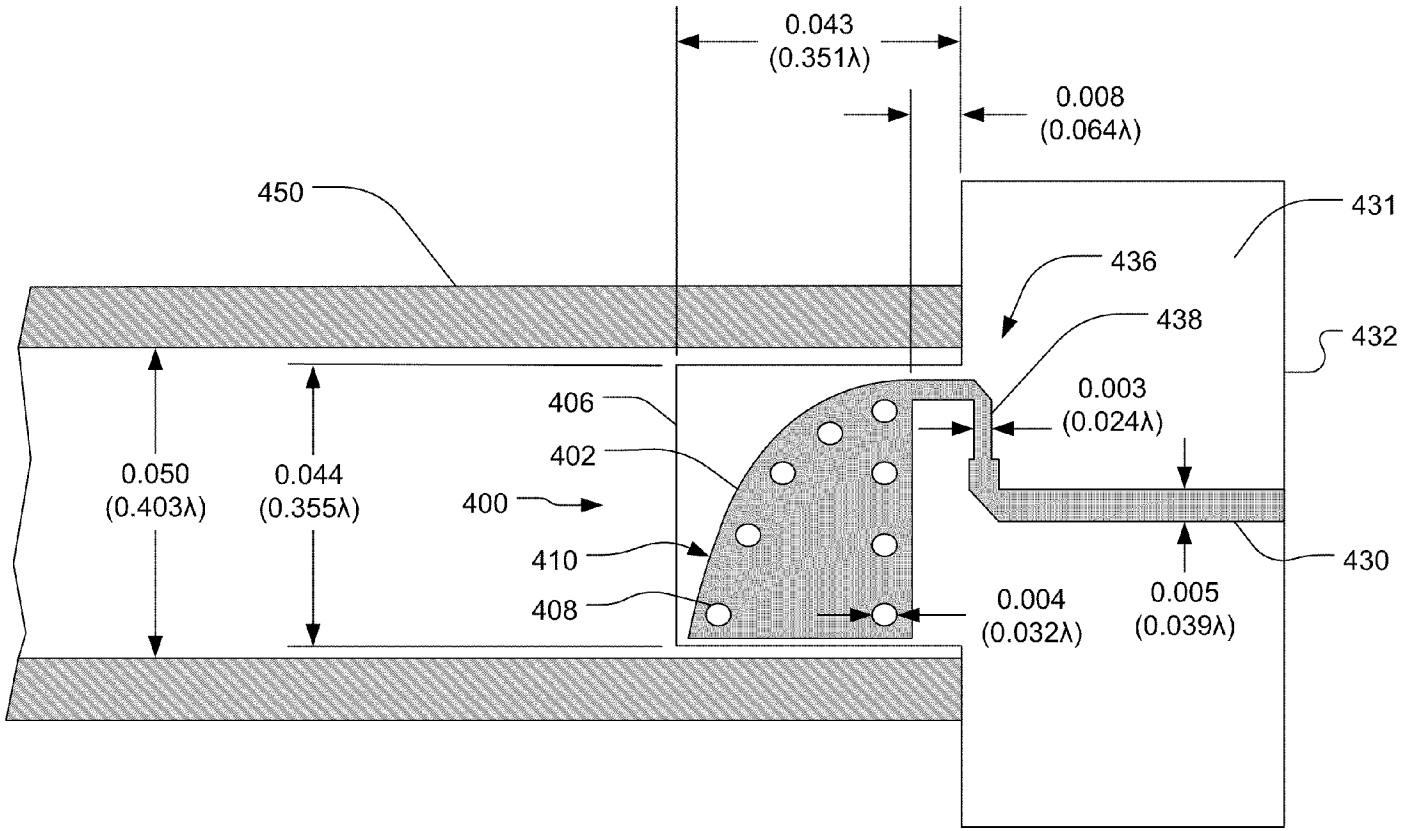
FIG. 5 is a cross-sectional view of the exemplary low loss broadband microstrip to waveguide transition.
Figure 6:
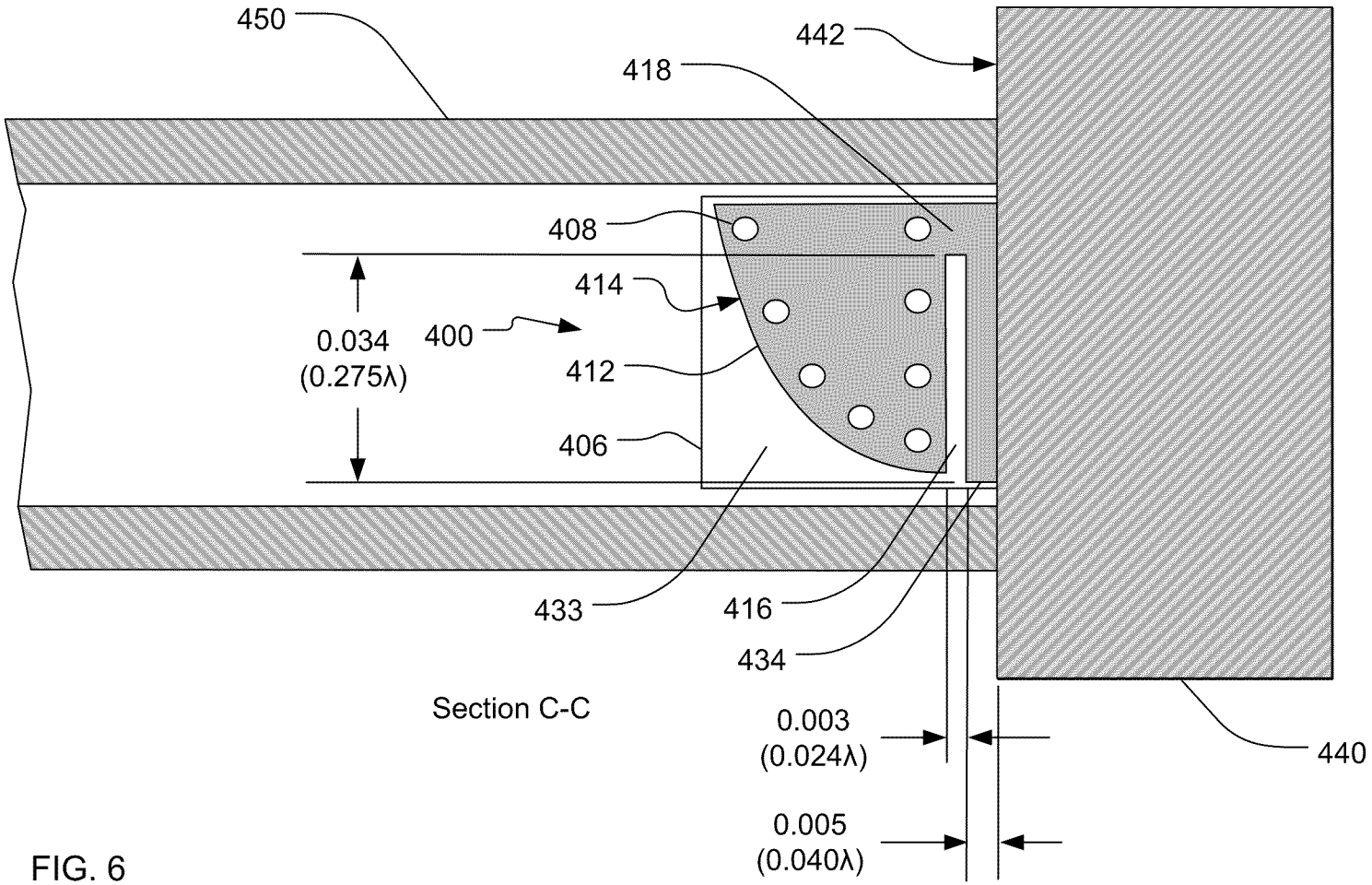
FIG. 6 is a cross-sectional view of the exemplary low loss broadband microstrip to waveguide transition.

FIGS. 4, 5, and 6 are cross-sectional views of specific exemplary half-notch antenna 400 designed to couple a 95 GHz signal from a microstrip line to a WG10 rectangular waveguide having internal dimensions of 0.05 inch by 0.10 inch. Dimensions in FIGS. 4, 5, and 6 are provided in inches for the specific example and as multiples of the signal wavelength, in parenthesis. The half notch antenna 400 of FIGS. 4, 5, and 6 may be scaled for other wavelengths and other waveguide dimensions.

A microstrip to waveguide transition, such as the half notch antenna 400, may be designed and simulated using a software tool adapted to solve three-dimensional electromagnetic field problems. The software tool may be a commercially available electromagnetic field analysis tool such as CST Microwave Studio™, Agilent's Momentum™ tool, or Ansoft's HFSS™ tool. The electromagnetic field analysis tool may be a proprietary tool using any known mathematical method, such as finite difference time domain analysis, finite element method, boundary element method, method of moments, or other methods for solving electromagnetic field problems. The software tool may include a capability to iteratively optimize a design to meet predetermined performance targets. The example of FIGS. 4, 5, and 6 may provide a starting point for the design of planer transmission line to waveguide transitions for other wavelengths and/or other waveguide shapes.

FIG. 4 shows a cross-sectional view of the exemplary microstrip to waveguide transition at a section plane A-A defined in FIG. 3. A microstrip line 430 may be formed on a first surface 431 of a dielectric substrate 432. A ground plane 434 may be formed on at least a portion of a second surface 433 of the dielectric substrate 432. The dielectric substrate 432 may be coupled to, and supported by, a ground plane slab 440 in electrical contact with the ground plane 434.

The half-notch antenna 400 may be formed on an extended portion of the dielectric substrate 432 that extends past an edge 442 of the ground plane slab 440 into an open end of a waveguide 450. The ground plane slab 440 may be in electrical contact with the waveguide 450. The ground plane slab 440 may block a portion 454 of the open end of the waveguide 450. Another portion 452 of the open end of the waveguide 450 may be unblocked. The unblocked portion 452 may be cut off (may not allow energy to exit the waveguide) at a frequency of operation of the micro strip to waveguide transition 400 if the height of the open portion 452 (0.030 inches in this example) is less than one-half of the wavelength at the frequency of operation. The height of the unblocked portion 452 may be a degree of design freedom that may be adjusted as part of optimizing the design of the micro strip to waveguide transition.

At longer wavelengths, the ground plane slab may block a central portion (not shown in FIG. 4) of the open end of the waveguide, leaving upper and lower unblocked portions (not shown). The open end of the waveguide may still be cutoff if the conductivity of the ground plane slab is sufficient to effectively short the open end of the waveguide.

FIG. 5 shows a cross-sectional view of the exemplary microstrip to waveguide transition at a section plane B-B defined in FIG. 4. FIG. 5 shows a cross-section of the waveguide 450 and a top view of the first surface 431 of the dielectric substrate 432. The micro strip line 430 may be formed on the first surface 431. A half-notch antenna 400 may be formed on an extended portion of the dielectric substrate 432. The half-notch antenna may include a first tapered conductor 402 formed on the first surface 431 of the extended portion 406.

The tapered conductor 402 may be connected to the microstrip line 430 through an impedance transformer 436, which may be implemented, for example, by a narrow (compared to the microstrip line 430) conductor 438 formed on the first surface 431. The impedance transformer 436 may be implemented by other conductor configurations formed on the first surface 431. The impedance transformer 436 may match the impedance of the microstrip line 430 to the half notch antenna 400.

An edge 410 of the tapered conductor 402 may be linear or curved. When the edge 410 is curved, as shown in FIG. 5, the tapered conductor 402 may be considered to form one-half of a Vivaldi antenna. The edge 410 may follow a circular, elliptical, parabolic, or other curved shape. The edge 410 may follow a series of linear segments or steps that approximate a curved shape.

The half-notch antenna 400 may include a second conductor (not visible) formed on a second surface of the extended portion 406. The tapered conductor 402 may be connected to the second conductor through one or more conductive vias 408. The conductive vias 408 may be, for example, plated through holes.

FIG. 6 shows a cross-sectional view of the exemplary microstrip to waveguide transition at a section plane C-C defined in FIG. 4. FIG. 5 shows a cross-section of the waveguide 450 and the ground plane slab 440, and a plan view of the second surface 433 of the extended portion 406 the dielectric substrate.

The half-notch antenna 400 may include a second tapered conductor 412 formed on the second surface 433 of the extended portion 406. An edge 414 of the second tapered conductor 412 may have essentially the same contour as the edge 410 of the first conductor 402 of FIG. 5.

The second tapered conductor 412 may be connected to the first tapered conductor 402 through plurality of conductive vias 408. A ground plane 434 may be formed on the second surface 433 of the dielectric substrate. The ground plane 434 may extend past the edge 442 of the ground plane slab 440 onto the extended portion 406 of the dielectric substrate. The second tapered conductor 412 may be separated from the ground plane 434 by a gap 416 extending over a portion of a width of the second tapered conductor, and may be connected to the ground plane 434 by a conductor 418.

Figure 7:
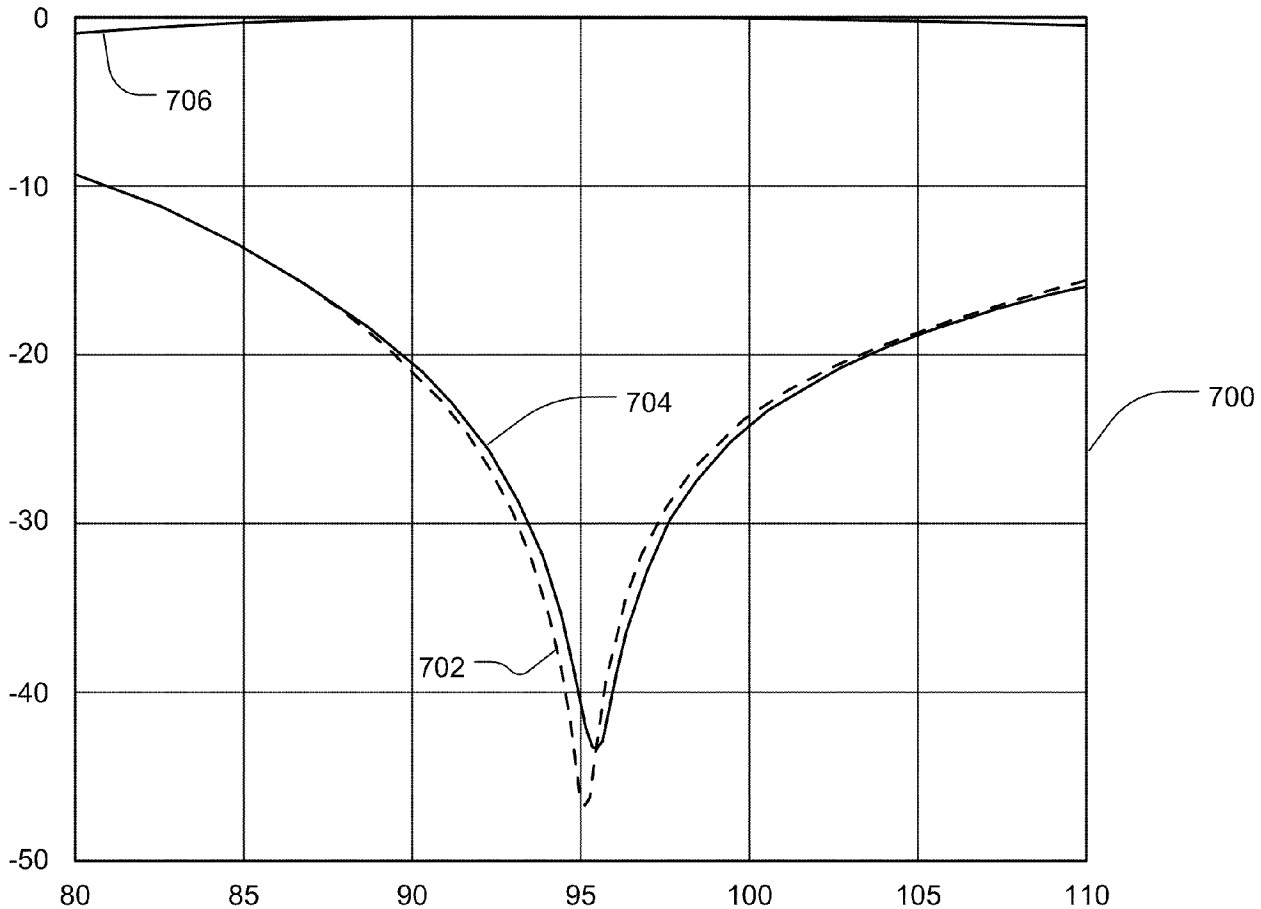
FIG. 7 is a chart showing measured performance of the exemplary low loss broadband microstrip to waveguide transition.

FIG. 7 shows a graph 700 of the expected W-band performance of a microstrip to waveguide transition, derived from simulation of the micro strip to waveguide transition 400 as shown in FIGS. 4, 5, and 6. The dashed line 702 and the solid line 704 represent the return loss for signals coupled from the micro strip to the waveguide, and from the waveguide to the micro strip, respectively. The return loss is more than 10 dB over a frequency band from about 81 GHz to more than 110

GHz. The solid line 706 represents the insertion loss for signals coupled from the microstrip to the waveguide. The insertion loss is less than 1 db over the 81 GHZ to 110 GHz frequency range. The insertion loss is nearly zero from 90 GHz to 100 GHz.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A transition for coupling a microwave signal between a transmission line formed on a planar dielectric substrate and a hollow waveguide, comprising: a half-notch antenna formed on an extended portion of the dielectric substrate, the extended portion adapted for insertion into an open end of the hollow waveguide.

2. The transition of claim 1, wherein the half-notch antenna comprises a first tapered conductor formed on a first surface of the dielectric substrate.

3. The transition of claim 2, wherein the first tapered conductor forms half of a Vivaldi antenna.

4. The transition of claim 2, wherein the half-notch antenna further comprises: a second tapered conductor formed on a second surface of the dielectric substrate at least one conductive via connecting the first tapered conductor and the second tapered conductor.

5. The transition of claim 4, wherein the second tapered conductor is coupled to a ground plane formed on the second surface of the dielectric substrate.

6. The transition of claim 2, wherein the transmission line is selected from the group consisting of: a micro strip line, a stripline, a slot line, and a coplanar waveguide.

7. The transition of claim 6, wherein the transmission line is a micro strip line formed on the first surface of the dielectric substrate the first tapered conductor is coupled to the micro strip line through an impedance transformer formed on the first surface of the dielectric substrate.

8. The transition of claim 1, wherein the dielectric substrate is coupled to a ground plane slab having a thickness sufficient to cut off the open end of the hollow waveguide.

9. The transition of claim 8, wherein a height of a portion of the open end of the hollow waveguide that is not blocked by the ground plane slab is less than one-half of a wavelength of the microwave signal.

10. The transition of claim 1, wherein a hollow passage of the waveguide extends from the open end of the hollow waveguide, and the wherein the waveguide hollow passage has a cross-sectional shape selected from rectangular, square, and circular.

11. A microwave signal transmission system, consisting of:

an elongated conductive waveguide having an open end and a hollow passage extending from the open end, the hollow passage configured to guide an electromagnetic wave;

a circuit module disposed proximate to the open end of the waveguide, the circuit module comprising a conductive ground plane slab having an edge disposed adjacent to the open end of the waveguide;

a dielectric substrate coupled to the conductive ground plane slab, the dielectric substrate including an extended portion extending beyond the edge of the ground plane slab into the hollow passage of the waveguide;

a half-notch antenna formed on the extended portion of the dielectric substrate, the half-notch antenna coupled to a transmission line formed on the dielectric substrate.

12. The microwave signal transmission system of claim 11, wherein the waveguide hollow passage has a cross-sectional shape selected from rectangular, square, and circular.

13. The microwave signal transmission system of claim 11, wherein the half-notch antenna comprises a first tapered conductor formed on a first surface of the dielectric substrate.

14. The microwave signal transmission system of claim 13, wherein the first tapered conductor forms half of a Vivaldi antenna.

15. The microwave signal transmission system of claim 13, wherein the half-notch antenna further comprises: a second tapered conductor formed on a second surface of the dielectric substrate at least one conductive via connecting the first tapered conductor and the second tapered conductor.

16. The microwave signal transmission system of claim 15, wherein the second tapered conductor is coupled to a ground plane formed on the second surface of the dielectric substrate.

17. The microwave signal transmission system of claim 13, wherein the transmission line is selected from the group consisting of a micro strip line, a stripline, a slot line, and a coplanar waveguide.

18. The microwave signal transmission system of claim 17, wherein the transmission line is a micro strip line formed on the first surface of the dielectric substrate the first tapered conductor is coupled to the micro strip line through an impedance transformer formed on the first surface of the dielectric substrate.

19. The microwave signal transmission system of claim 11, wherein the ground plane slab blocks a sufficient portion of the open end of the waveguide to cut off the open end of the waveguide.

20. The microwave signal transmission system of claim 19, wherein a height of an unblocked portion of the open end of the waveguide is less than one-half of a wavelength of the microwave signal.

* * * * *